US010360824B1

(12) United States Patent
Formel et al.

(10) Patent No.: US 10,360,824 B1
(45) Date of Patent: Jul. 23, 2019

(54) CUSTOMIZABLE CIRCULAR EXIT SIGN

(71) Applicant: Cooper Technologies Company, Houston, TX (US)

(72) Inventors: Scott Peter Formel, Peachtree City, GA (US); Anthony Reale, Allen Park, MI (US); Joseph Cazeno, III, Farmington Hills, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/495,702

(22) Filed: Apr. 24, 2017

Related U.S. Application Data

(60) Provisional application No. 62/326,507, filed on Apr. 22, 2016.

(51) Int. Cl.
*G09F 7/02* (2006.01)
*G09F 7/18* (2006.01)
*G09F 13/04* (2006.01)

(52) U.S. Cl.
CPC ..... *G09F 7/02* (2013.01); *G09F 7/18* (2013.01); *G09F 13/0413* (2013.01); *G09F 2007/1843* (2013.01); *G09F 2007/1873* (2013.01); *G09F 2013/0459* (2013.01)

(58) Field of Classification Search
CPC ..... G09F 7/02; G09F 13/0413; G09F 2007/1843; G09F 2013/0459
See application file for complete search history.

(56) References Cited

U.S. PATENT DOCUMENTS 1,534,222 A * 4/1925 Lackstrom ..... B60Q 1/34 362/812
2,050,769 A * 8/1936 Stone ..... B60Q 1/34 40/572
2,547,192 A * 4/1951 Zentner ..... B60Q 1/34 40/572
2,878,462 A * 3/1959 Tralli ..... B60Q 1/50 340/468
3,780,284 A * 12/1973 Dewhirst ..... F21V 17/00 362/260
4,157,531 A * 6/1979 Mont ..... B60Q 7/02 116/63 P
4,967,317 A * 10/1990 Plumly ..... G08B 7/062 362/243
5,485,145 A * 1/1996 Sniff ..... G08B 7/062 340/815.4
6,132,070 A * 10/2000 Vosika ..... F21V 21/02 362/368
6,240,665 B1 * 6/2001 Brown ..... G09F 13/04 40/570
6,467,208 B1 * 10/2002 Patterson ..... G09F 13/04 248/900
7,814,692 B2 * 10/2010 Wiltfang ..... G09F 7/18 40/606.18

(Continued)

*Primary Examiner* — Gary C Hoge
(74) *Attorney, Agent, or Firm* — King & Spalding LLP

(57) ABSTRACT

A customizable circular exit sign structure includes a ring-shaped frame, and a face plate having a word EXIT formed therethrough. The face plate is attached to the frame on a side of the frame. The customizable circular exit sign structure also includes a trim ring positioned along a perimeter edge of the frame and along a perimeter edge of the face plate. The face plate is customizable to have a particular color.

19 Claims, 11 Drawing Sheets

(56) References Cited

U.S. PATENT DOCUMENTS

| | | | | |
|---|---|---|---|---|
| 9,080,747 | B1 * | 7/2015 | Hetrick | F21V 14/06 |
| 2014/0047746 | A1 * | 2/2014 | Errair | A47G 1/0627<br>40/711 |

* cited by examiner

CUSTOMIZABLE CIRCULAR EXIT SIGN

RELATED APPLICATIONS

The present application claims priority under 35 U.S.C. § 119(e) to U.S. Provisional Patent Application No. 62/326,507, filed Apr. 22, 2016, and titled "Customizable Circular Exit Sign," the entire content of which is incorporated herein by reference.

TECHNICAL FIELD

The present disclosure relates generally to exit sign structures, and more particularly to customizable exit signs.

BACKGROUND

Exit signs are often installed at various locations throughout buildings to guide people toward exits from the buildings and to identify building exits. In some cases, exit signs create visual disturbances of the space at which the exit signs are installed. For example, the overall appearance of an exit sign may not blend well with some aspects of the space at which an exit sign is installed. To illustrate, the shape, color, and/or texture of an exit sign may clash with the wall color, entrances, etc. Thus, it may be desirable to have exit signs that blend with the overall environment in which the exit signs are installed.

SUMMARY

The present disclosure relates generally to exit sign structures, and more particularly to customizable exit signs. In an example embodiment, a customizable circular exit sign structure includes a ring-shaped frame, and a face plate having a word EXIT formed therethrough. The face plate is attached to the frame on a side of the frame. The customizable circular exit sign structure also includes a trim ring positioned along a perimeter edge of the frame and along a perimeter edge of the face plate. The face plate is customizable to have a particular color.

In another example embodiment, a customizable circular exit sign structure includes a ring-shaped frame and a first face plate having a word EXIT formed therethrough. The first face plate is attached to the frame on a first side of the frame, and the first face plate is customizable to have a particular color. The customizable circular exit sign structure also includes a second face plate, wherein the second face plate is attached to the frame on a second side of the frame across from the first face plate.

In another example embodiment, a method of customizing a circular exit sign structure includes removing a first trim ring from the exit sign and removing a first face plate from the exit sign. The method further includes attaching a replacement face plate to the exit sign, wherein the first face plate and the replacement face plate have different appearances from each other.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1A:
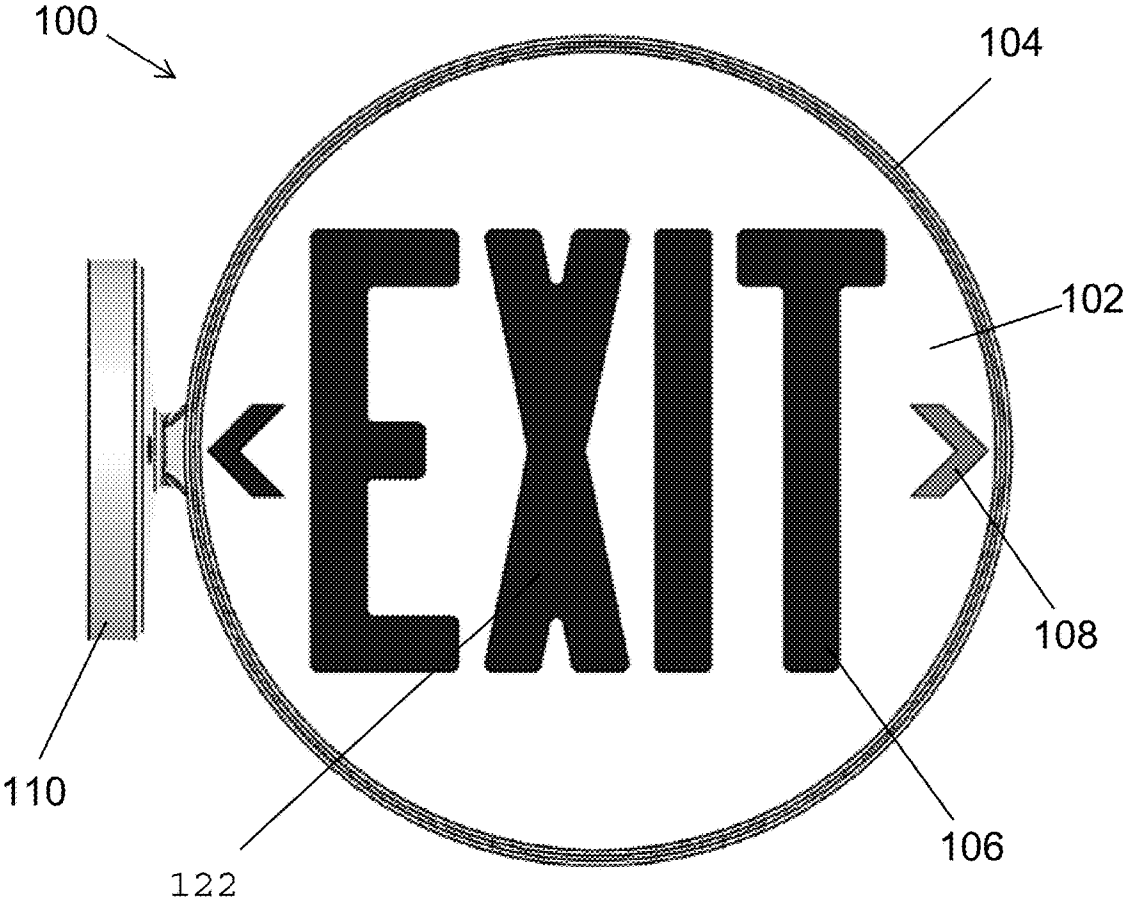
FIGS. 1A and 1B illustrate a customizable circular exit sign structure according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

In some applications, a light emitting diode (LED) exit sign structure that has a generally circular shape and that can have a customer specified color or texture of both the face plate(s) and the trim ring(s) may be desirable. For example, the LED exit sign may be circular having a circumference of 2*pie*radius and an area of pie*radius$^2$. The LED exit sign may be customized at the time of initial installation or can be modified after initial installation. In some example embodiments, customizable face plate(s) and trim ring(s) can be attached to another structure of the LED Exit sign mechanically, chemically or magnetically. The LED exit sign can be powered by AC input, Power over Ethernet connection, DC input or from a battery.

Figure 1B:
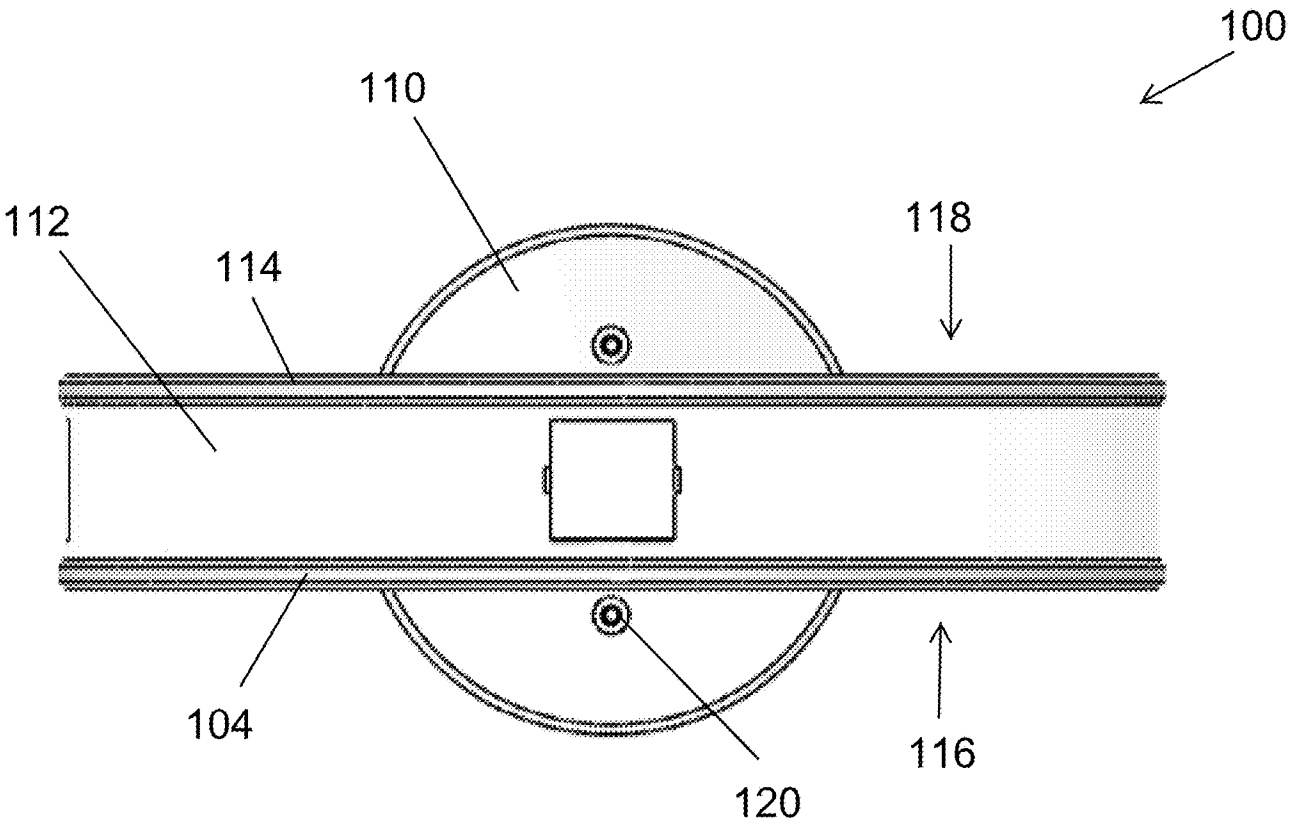

Turning now to the figures, particular example embodiments are described. FIGS. 1A and 1B illustrate a customizable circular exit sign structure 100 according to an example embodiment. Referring to FIGS. 1A and 1B, in some example embodiments, the customizable circular exit sign structure 100 includes a face plate 102 and trim rings 104, 114. The customizable circular exit sign structure 100 may also include a frame 112 that is disposed between the trim rings 104, 114. The face plate 102 is positioned on one side 116 of the frame 112. The face plate 102 may be attached to the frame 112 using one or more clips, an adhesive material, or magnetically, depending on the material used in the face plate 102 and the frame 112. In some example embodiments, the face plate 102 may be attached to another structure (e.g., an inner plate) of the customizable circular exit sign structure 100 mechanically, chemically, and/or magnetically without a direct attachment to the frame 112. For example, an inner plate may be attached to the frame 112 behind the face plate 102, and the face plate 102 may be attached to the inner plate.

In some example embodiments, the circular exit sign structure 100 may also include another face plate on another side 118 of the frame 112 opposite the first side 116. To illustrate, the frame 112 may extend between the two face plates. For example, the frame 112 and the face plate 102 and the other face plate may form a cavity. A light source (e.g., an LED light source) that illuminates the customizable circular exit sign structure 100 as well as other electrical components may be positioned in the cavity.

In some example embodiments, the frame 112 is a ring-shaped structure. The width of the frame 112 extending between the perimeter edges of the frame 112 may generally define the size of the cavity between the two face plates. The trim rings 104, 114 may also be ring-shaped structures. To illustrate, the trim ring 104 may be positioned along a perimeter edge of the frame 112 on the side 116 of the frame 112, and the trim ring 114 may be positioned along the other perimeter edge of the frame 112 that is on the side 118 of the frame 112. The trim rings 104, 114 may each be attached to the frame 112 and/or the face plate 102, for example, mechanically (e.g., clips), chemically (e.g., using an adhesive), and/or magnetically. In some alternative embodiments, the trim ring 104 may be attached to the face plate 102 instead of or in addition to the frame 112 mechanically, chemically, and/or magnetically. The trim ring 114 may similarly be attached to other face plate opposite the face plate 102 instead of or in addition to the frame 112. The trim rings 104, 114 may be slid over the frame 112 from the respective side 116, 118 to attach the trim rings 104, 114 to the frame 112 and/or to the respective face plate.

In some example embodiments, the face plate 102 has a generally circular shape. For example, the trim ring 104 may be positioned along an outer perimeter edge of the face plate 102 on the side 116 of the frame 112. The trim ring 114 may also be positioned along an outer perimeter edge of the other face plate on the side 118 of the frame 112. The face plate 102 may include a word EXIT 106 that is formed in or through the face plate 102. The word EXIT 106 may be compliant with Underwriters Laboratories (UL) or other requirements. Other signs, such as a direction sign 108, may also be formed in or through the face plate 102. The word EXIT 106 and the other signs, such as the direction sign 108, may be illuminated by a light source (such as an LED light source) that is behind the face plate 102. The other signs, such as the direction sign 108, may also be compliant with UL or other requirements. The other face plate that is on the side 118 of the frame 112 may also have the word EXIT 106 that is formed in or through the face plate.

In some example embodiments, the other face plate that is on the side 118 of the frame 112 is substantially the same as the face plate 102 with respect to appearances (e.g., shape), and other characteristics. In some alternative embodiments, the other face plate that is on the side 118 of the frame 112 may be a back cover plate that does not have the word EXIT 106 or another sign formed in or through the surface of the back cover plate. For example, the other face plate that is on the side 118 of the frame 112 may be a mounting plate that is used to mount the customizable circular exit sign structure 100 on a wall.

In some example embodiments, the customizable circular exit sign structure 100 may include a mounting structure 110 that is, for example, attached to the frame 112 and used to mount the customizable circular exit sign structure 100 on a wall or a ceiling. For example, the frame 112 may include a structure or a hole to enable attachment of the mounting structure 110 to the frame 112. The mounting structure 112 may be attached to a wall or a ceiling using fasteners that extend through one or more holes 120. In some example embodiments, the customizable circular exit sign structure 100 may include a letter backing 122 that is placed against the word EXIT 206 in the cavity of the customizable circular exit sign structure 100. The letter backing 122 may have a particular color (e.g., red) and may allow light to pass therethrough to enhance visibility of the word EXIT 202.

In some example embodiments, the face plate 102 may have a color that meets a particular need or request. For example, the face plate 102 may be customizable to have a color based on a customer request. To illustrate, the color of the face plate 102 may be selected to blend with an environment in which the customizable circular exit sign structure 100 will be or is used. In some example embodiments, the texture of the surface of the face plate 102 may also be selected to meet a particular need or request. For example, the texture of the face plate 102 may also be selected to blend with an environment in which the customizable circular exit sign structure 100 will be or is used. For example, the color and/or texture of the face plate 102 may be selected to blend with the color and/or texture of a wall and/or ceiling to which the customizable circular exit sign structure 100 will be attached. In some example embodiments, the trim rings 104, 114 may also have a color and/or texture that are selected to meet a particular need or request such as a request by a customer.

In some example embodiments, the face plate 102 may be replaced, before or after installation of the customizable circular exit sign structure 100, with another face plate that has a color and/or texture that better meets a need/request, for example, of a customer. Similarly, the face plate that is on the side 118 of the frame 112 may be replaced, before or after installation of the customizable circular exit sign structure 100, with another face plate that has a color and/or texture that better meets a need/request, for example, of a customer. In some example embodiments, the trim rings 104, 114 may each be replaced, before or after installation of the customizable circular exit sign structure 100, with another trim ring that has a color and/or texture that better meets a need/request, for example, of a customer.

The face plate 102, the frame 112, and the trim rings 104, 114 may be made from the same material or different materials. For example, the face plate 102, the frame 112, and the trim rings 104, 114 may each be made from metal (e.g., aluminum), plastic, and/or glass using one or more methods such as molding, milling, pressing.

The customizable circular exit sign structure 100 enables the color and texture of both the face plate(s) and/or trim ring(s), when present, to be specified as well as field modified, allowing the customizable circular exit sign structure 100 to be incorporated into the visual theme of a space.

In some example embodiments, the customizable circular exit sign structure 100 may be customized by removing the trim ring 104, removing a face plate 102, and attaching a replacement face plate to the frame 112. For example, the replacement face plate may have a different appearance from the face plate 102. To illustrate, the color and/or texture of the replacement face plate may be different from those of the face plate 102. A replacement trim ring or the trim ring 104 may be attached back to the frame 112 after the replacement face plate is attached to the frame 112. In some alternative embodiments, the trim ring 104 may be replaced without replacing the face plate 102. In some example embodiments, the other plate (e.g., another face plate or back plate) that is across from the face plate 102 may be replaced in a similar manner as the face plate 102 after removing the trim ring 114. The trim ring 114 may also be replaced by a replacement trim ring.

In some alternative embodiments, the mounting structure 110 may be at a different position than shown in FIG. 1A without departing from the scope of this disclosure. For example, the mounting structure 110 may be approximately 90 degrees rotated from the position shown in FIG. 1A. In some example embodiments, the mounting structure 110 may be omitted without departing from the scope of this disclosure. In some example embodiments, the trim ring 104 and/or the trim ring 114 may be omitted without departing from the scope of this disclosure.

Figure 2A:
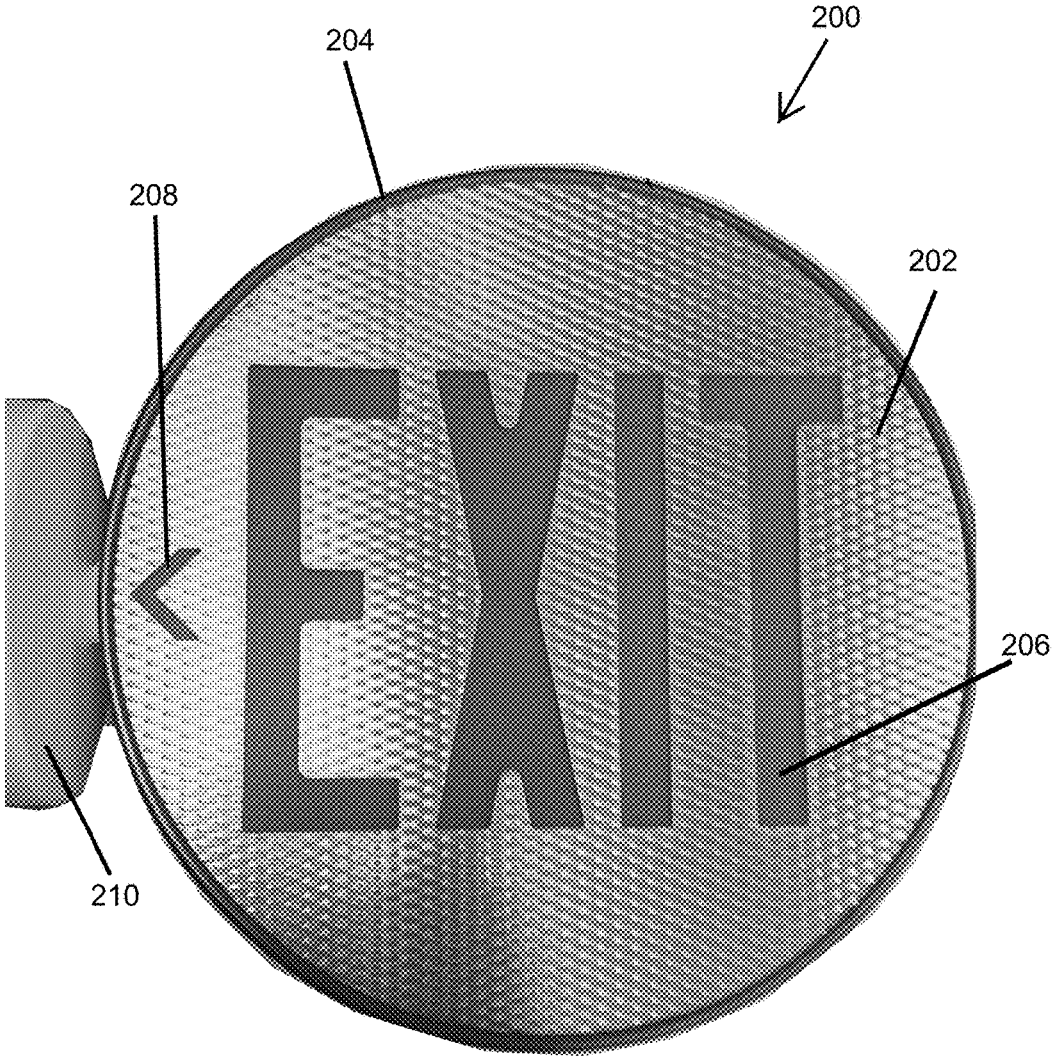
FIGS. 2A and 2B illustrate a customizable circular exit sign structure according to another example embodiment.
Figure 2B:
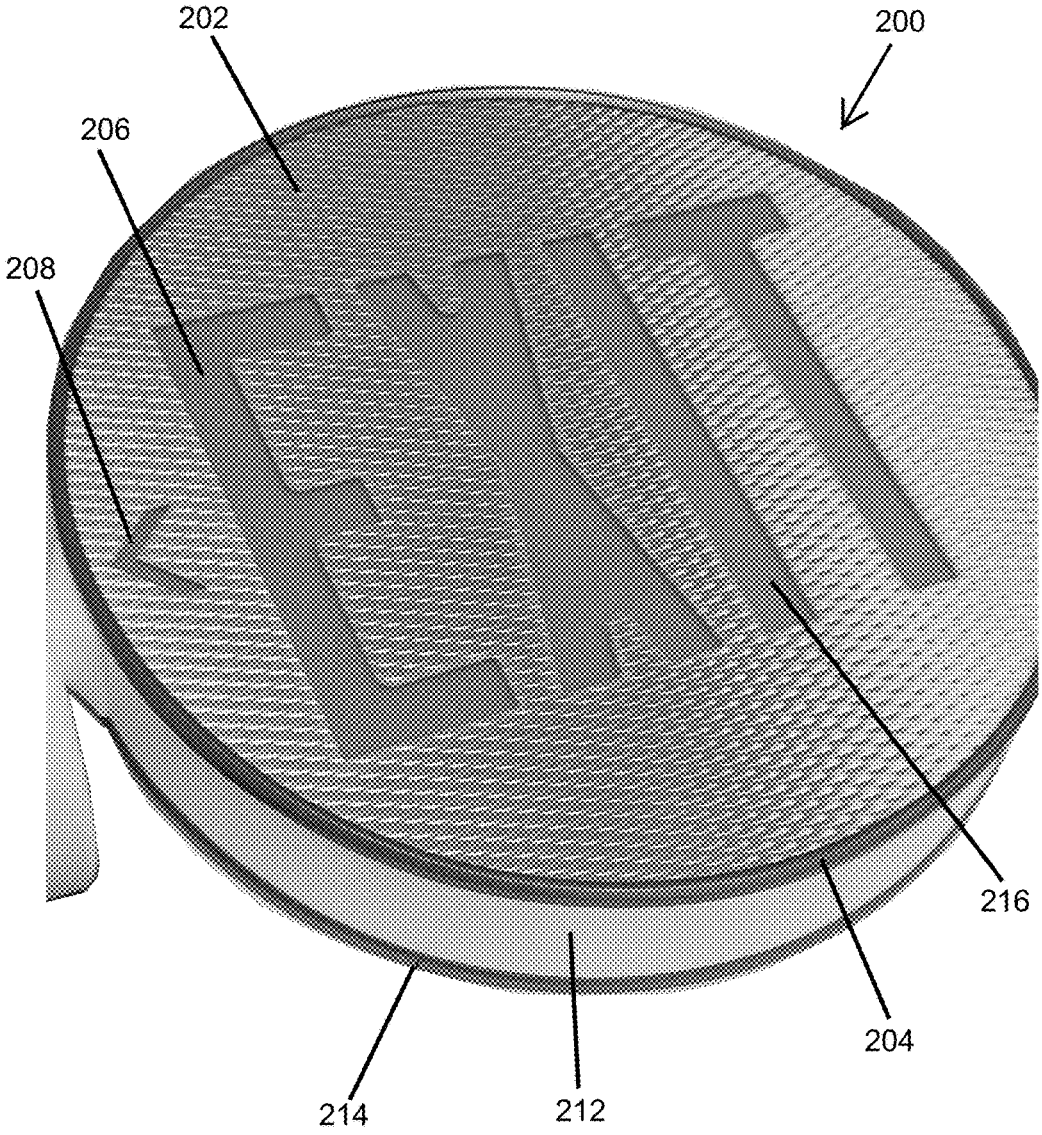

FIGS. 2A and 2B illustrate a customizable circular exit sign structure 200 according to another example embodiment. The customizable circular exit sign structure 200 includes a face plate 202, trim rings 204, 214, and a frame 212. A word EXIT 206 is formed in or through the face plate 202. The face plate 202 may also include a direction sign 208. The customizable circular exit sign structure 200 may include another face plate that is similar to the face plate 202 on the opposite side of the frame 212 from the face plate 202.

In some example embodiments, the customizable circular exit sign structure 200 may have a cavity that is formed between the face plate 202, the frame 212, and the other face plate that is opposite the face plate 202 across the frame 212. The frame 212 may be generally ring-shaped, i.e., circular. The trim rings 204, 214 may also be generally ring-shaped, and the face plate 202 may be generally circular. The trim ring 204 is positioned along an outer perimeter edge of the face plate 202 and along the perimeter edge of the frame 212 on one side of the frame 212. The trim ring 214 is positioned along an outer perimeter edge of the other face plate and along another perimeter edge of the frame 212 on another side of the frame 212.

In some example embodiments, the customizable circular exit sign structure 200 may include a letter backing 216 that is placed against the word EXIT 206. The letter backing 216 may have a particular color (e.g., red) and may allow light to pass therethrough to enhance visibility of the word EXIT 202.

The face plate 202 and the trim rings 204, 214 may be customizable to have color(s) and texture(s) as described above with respect to the face plate 102 and the trim rings 104, 114. In some example embodiments, the customizable circular exit sign structure 200 corresponds to the customizable circular exit sign structure 100. For example, the face plate 202, the frame 212, and the trim rings 204, 214 may have the same shape and may be made from the same material and using similar methods as described above with respect to the customizable circular exit sign structure 100. The face plate 202 and the trim rings 204, 214 may be attached to the frame 212 or another structure of the customizable circular exit sign structure 200 in a similar manner as described with respect to FIG. 1.

Although the face plate 202, the frame 212, and the trim rings 204, 214 are shown as having circular shapes, in some alternative embodiments, the face plate 202, the frame 212, and the trim rings 204, 214 may have other shapes that are not circular without departing from the scope of this disclosure.

Figure 3:
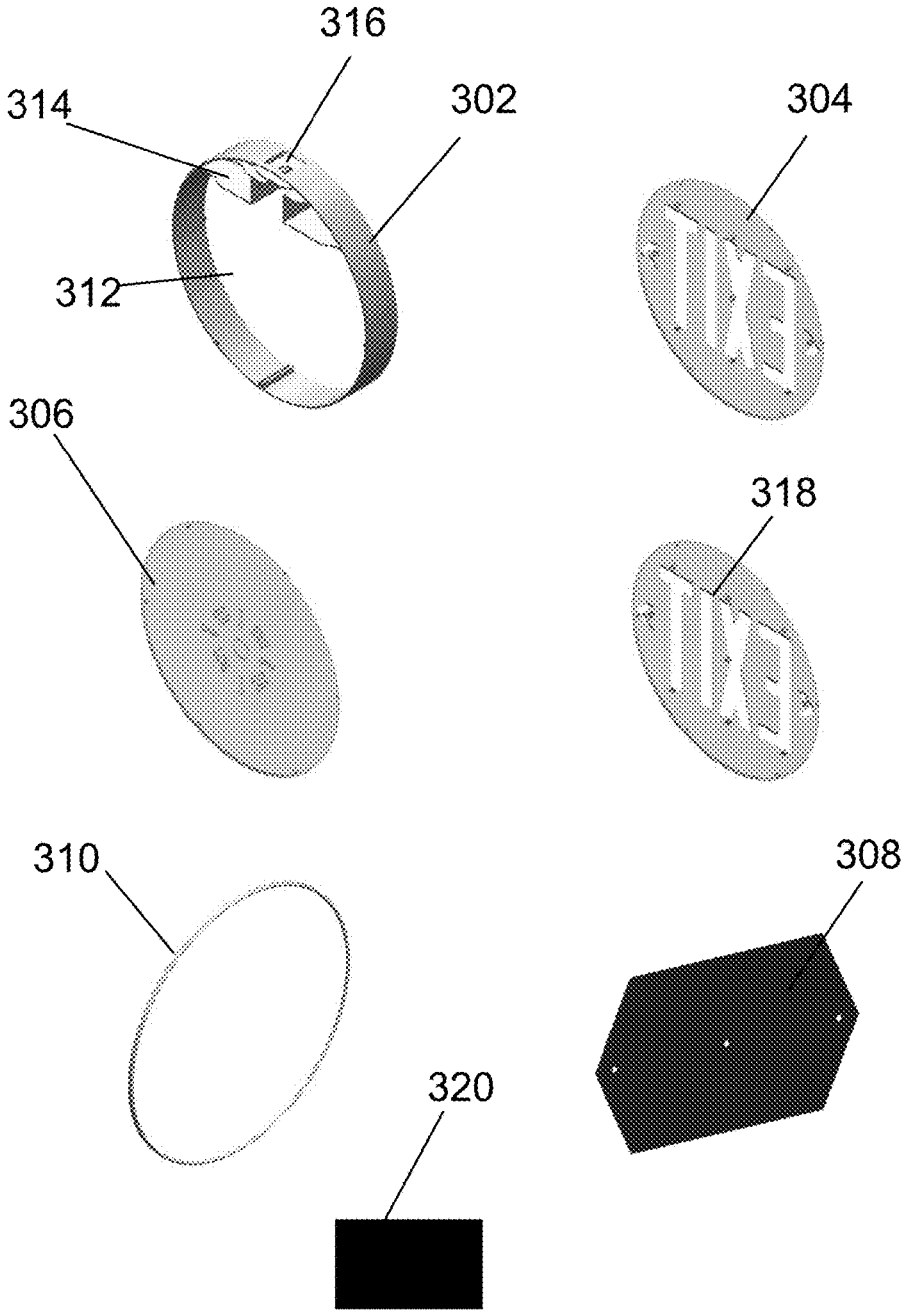
FIG. 3 illustrates some components of the customizable circular exit sign structure of FIGS. 1A, 1B, 2A and 2B according to an example embodiment.

FIG. 3 illustrates some components of the customizable circular exit sign structure 100, 200 of FIGS. 1A, 1B, 2A and 2B according to an example embodiment. Referring to FIGS. 1A-3, the frame 302 may correspond to the frame 112, 212. A face plate 304 may correspond to the face plate 102, 202. A plate 318 may be a face plate that is positioned opposite the face plate 102, 202 in FIGS. 1A and 2B, respectively. In some alternative embodiments, the plate 318 may be attached to the frame 302, and the face plate 304 may be overlaid on the plate 318. For example, the face plate 304 may be customizable as described above with respect to face plates 102, 202, and the plate 318 may be used without customization. For example, the plate 318 may be integrally formed with the frame 302. In some alternative embodiments, the face plate that is positioned opposite face plate 102, 202 described above may be a back plate 306. For example, the plate 306 may be used to mount the customizable circular exit sign structure 100, 200 against a wall, and may not be viewable once the customizable circular exit sign structures 100, 200 are installed.

In some example embodiments, a letter backing 308 may correspond to the letter backing 122, 216, and a trim ring 310 may correspond to the trim rings 104, 114, 204, 214. A light source (e.g., a circuit board with LEDs) 320 may be positioned in a cavity of the customizable circular exit sign structure 100, 200. For example, the frame 302 may include one or more shelves 314 where a light source 320 may be placed. The frame 316 may also include an attachment hole/structure 316 for receiving a mounting structure such as the mounting structure 110 that is used to mount the customizable circular exit sign structure 100, 200, for example, to a wall or a ceiling. The face plate 304 may cover a space 312 surrounded by the frame 302 on one side of the frame 302, and the plate 318 or the back plate 306 may cover the space 312 surrounded by the frame 302 on the opposite side of the frame 302. The color and/or texture of the face plate 304, the plate 318 and the trim ring 318 may be according to a request or specification and may be installable and replaceable at manufacturing, in the field at the time of installation, and/or after installation.

Figure 4:
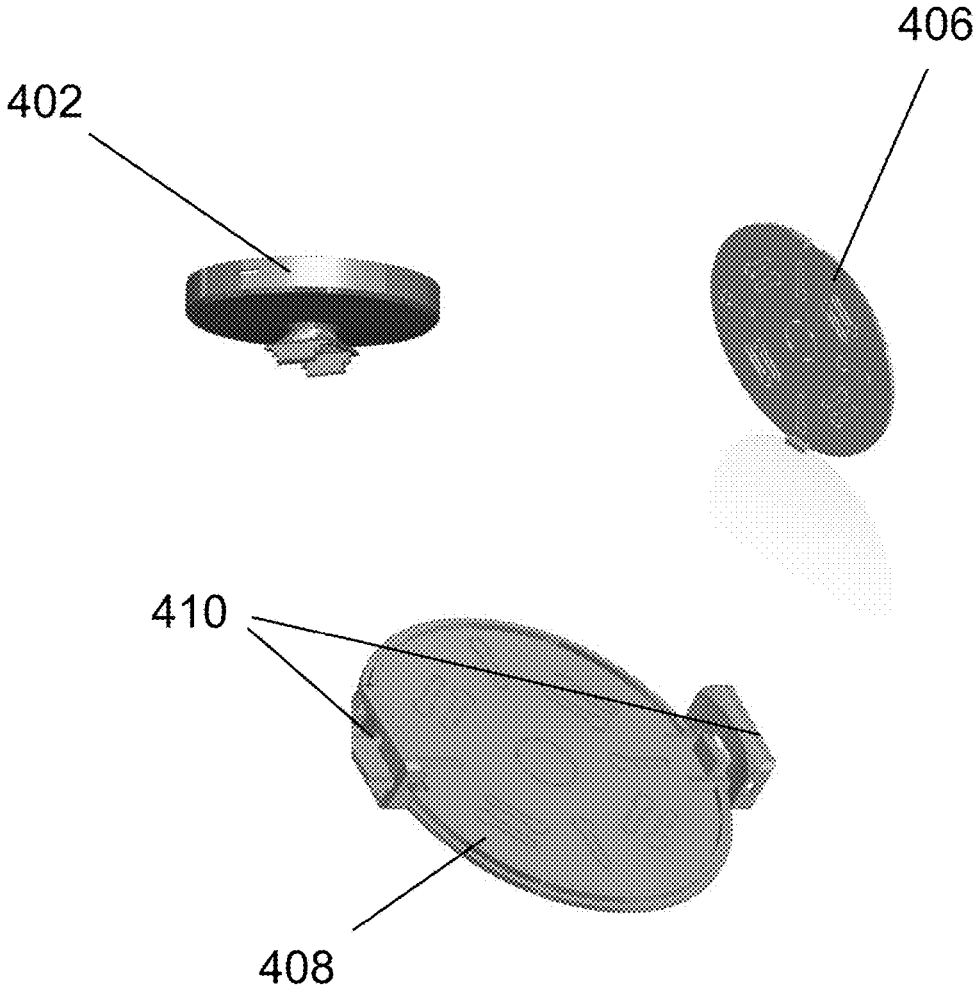
FIG. 4 illustrates a mounting structure for mounting the customizable circular exit sign structure of FIGS. 1A, 1B, 2A and 2B according to an example embodiment.

FIG. 4 illustrates a mounting structure for mounting the customizable circular exit sign structure 100, 200 of FIGS. 1A, 1B, 2A and 2B according to an example embodiment. Referring to FIGS. 1A-4, a mounting structure 402 may be attached to the frame 112, 212, 302. For example, the mounting structure 402 may correspond to the mounting structure 110, 210 and may be attached to the frame 302 at the mounting hole/structure 316. A mounting plate 406 may be attached to the mounting structure to enable attachment to the mounting structure 402 to a wall or a ceiling. An attachment piece 408 may be attached to the mounting structure 402 and may enable attachment of other structures to the customizable circular exit sign structure 100, 200 via clips 410.

Figure 5A:
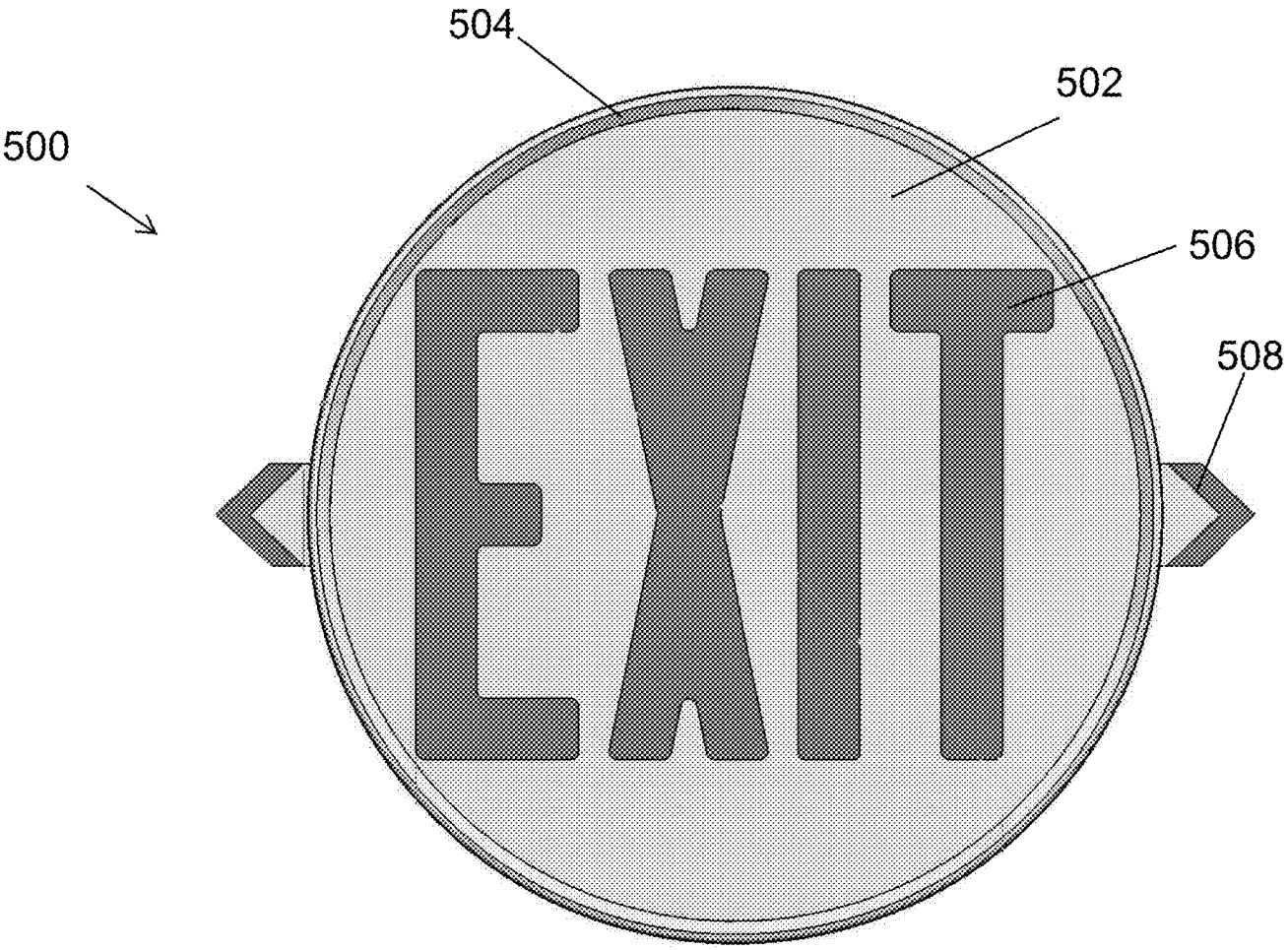
FIGS. 5A and 5B illustrate a customizable circular exit sign structure according to another example embodiment.
Figure 5B:
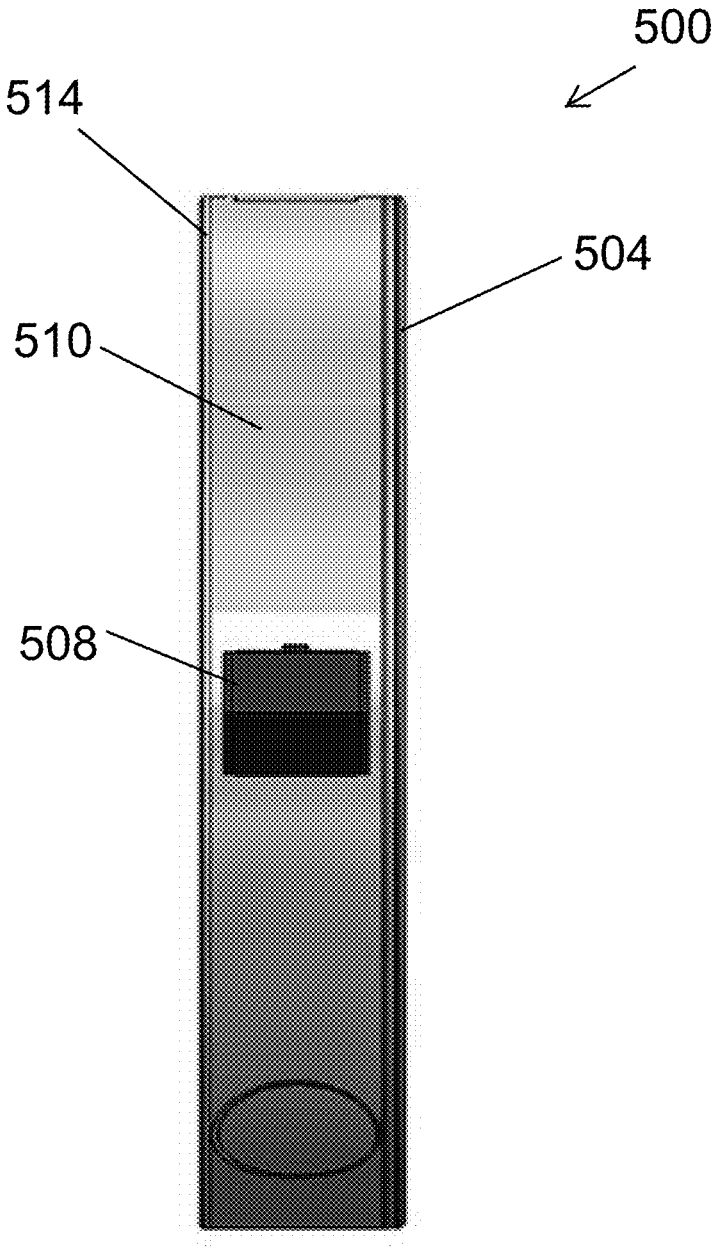

FIGS. 5A and 5B illustrate a customizable circular exit sign structure 500 according to another example embodiment. In some example embodiments, the customizable circular exit sign structure 500 is similar to the customizable circular exit sign structure 100, 200. The customizable circular exit sign structure 500 includes a face plate 502, trim rings 504, 514, one or more direction sign structures 508, and a frame 510. The face plate 502 may include a word EXIT 506 that is formed in or through the face plate 502. Focusing on the primary differences between the customizable circular exit sign structure 500 and the customizable circular exit sign structures 100, 200, the customizable circular exit sign structure 500 includes the one or more direction sign structures that extend out from radial sides of the customizable circular exit sign structure 500 in contrast to the direction signs 108, 208 that are formed in the face plates 102, 202, respectively. For example, the direction sign structures 508 may extend out from the frame 510 as more clearly shown in FIG. 5B.

In some example embodiments, the trim ring 504 and the trim ring 514 may be similar to each other. For example, the trim rings 504, 514 may have the same shape, color, and/or texture.

In some example embodiments, the customizable circular exit sign structure 500 may also include another face plate that is similar to the face plate 502 opposite the face plate 502 across the frame 510. Alternatively, the customizable circular exit sign structure 500 may include a back cover plate, similar to the back cover plate 306, shown in FIG. 3. The face plate 502, the trim rings 504, 514, and/or the other face plate (when present) may be customizable in a similar manner as described above with respect to the face plates and the trim rings of the customizable circular exit sign structure 100, 200. In some alternative embodiments, one or both trim rings 504, 514 may be omitted.

Figure 6A:
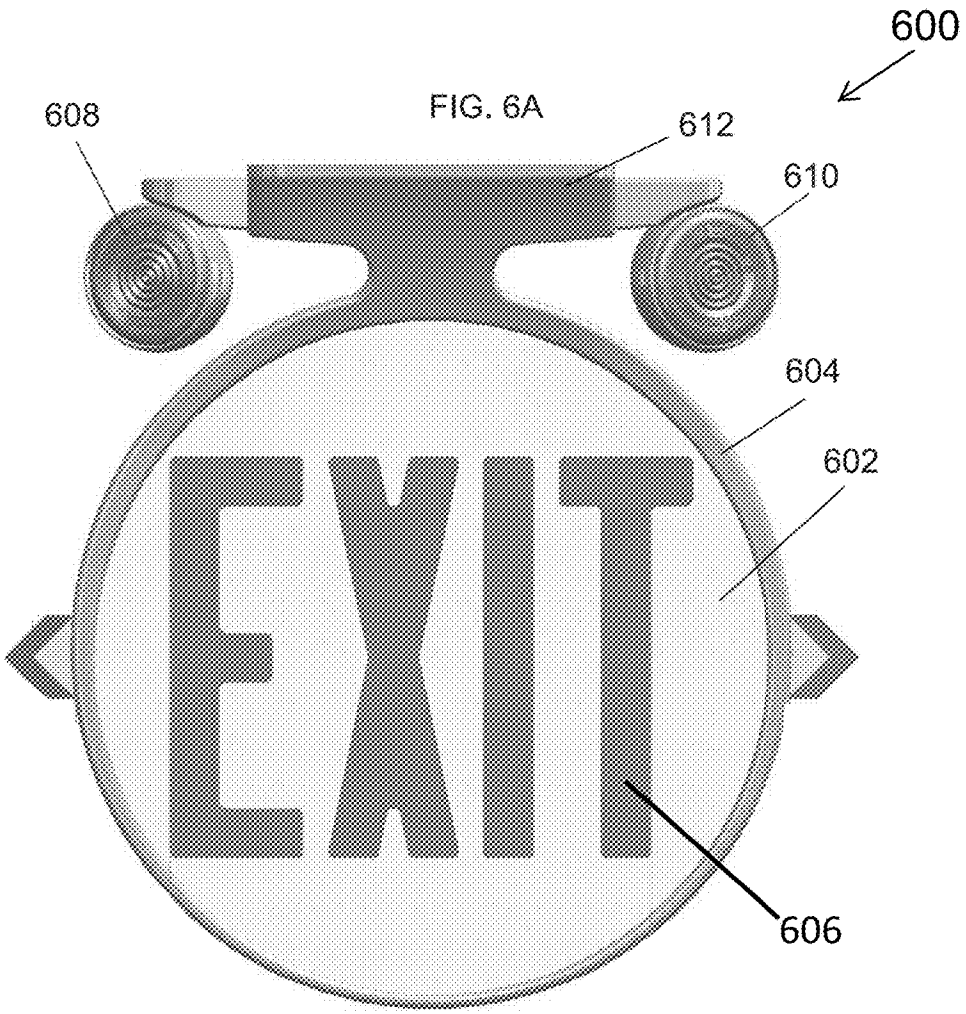
FIGS. 6A and 6B illustrate a customizable circular exit sign structure according to another example embodiment.
Figure 6B:
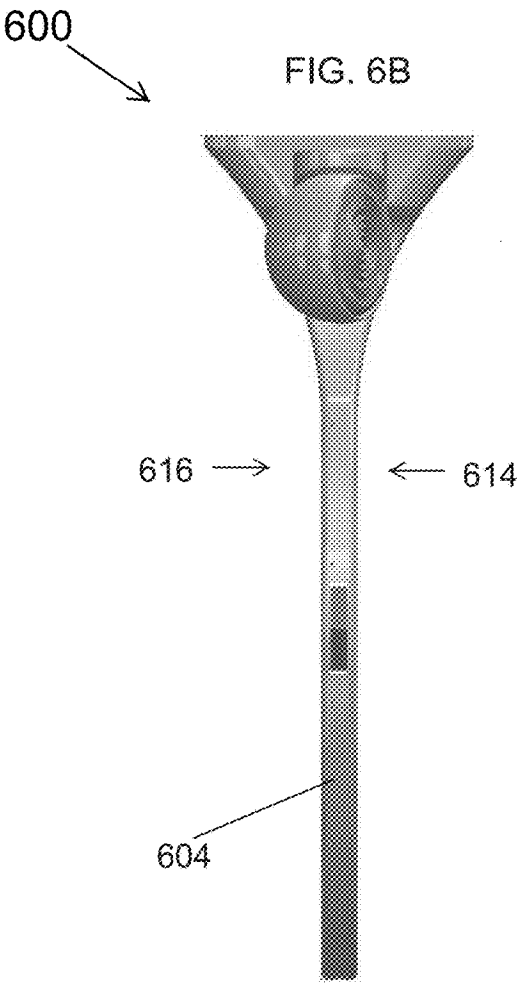

FIGS. 6A and 6B illustrate a customizable circular exit sign structure 600 according to another example embodiment. Referring to FIGS. 6A and 6B, in some example embodiments, the customizable circular exit sign structure 600 includes a face plate 602 and a frame 604 that is positioned around the face plate 602. The face plate 602 may include a word EXIT 606 that is formed in or through the face plate 602. In some example embodiments, the face plate 602 may be similar to the face plate 102, 202, 502. In contrast to the customizable circular exit sign structures 100, 200, 500, the trim ring(s) may be omitted from the customizable circular exit sign structure 600 or may be integrated with the frame 604. The frame 604 may be positioned such that outer perimeter edge of the face plate 602 is covered by the frame 604.

In some example embodiments, a mounting structure 612 that is used to attach the customizable circular exit sign structure 600 to a ceiling or a wall may be integrated with the frame 604. The customizable circular exit sign structure 600 may also include light sources 608 and 610 that are attached to mounting structure 612. The face plate 602 may be on a side 614 of the frame 604, and similar to the customizable circular exit sign structure 100, 200, 500, the customizable circular exit sign structure 600 may include another face plate or a back plate on a side 616 of the frame 604 across from the face plate 602. When another face plate or a back plate is present across the face plate 602, the frame 604 may be positioned such that outer perimeter edge of the other face plate or back plate is covered by the frame 604.

Figure 7A:
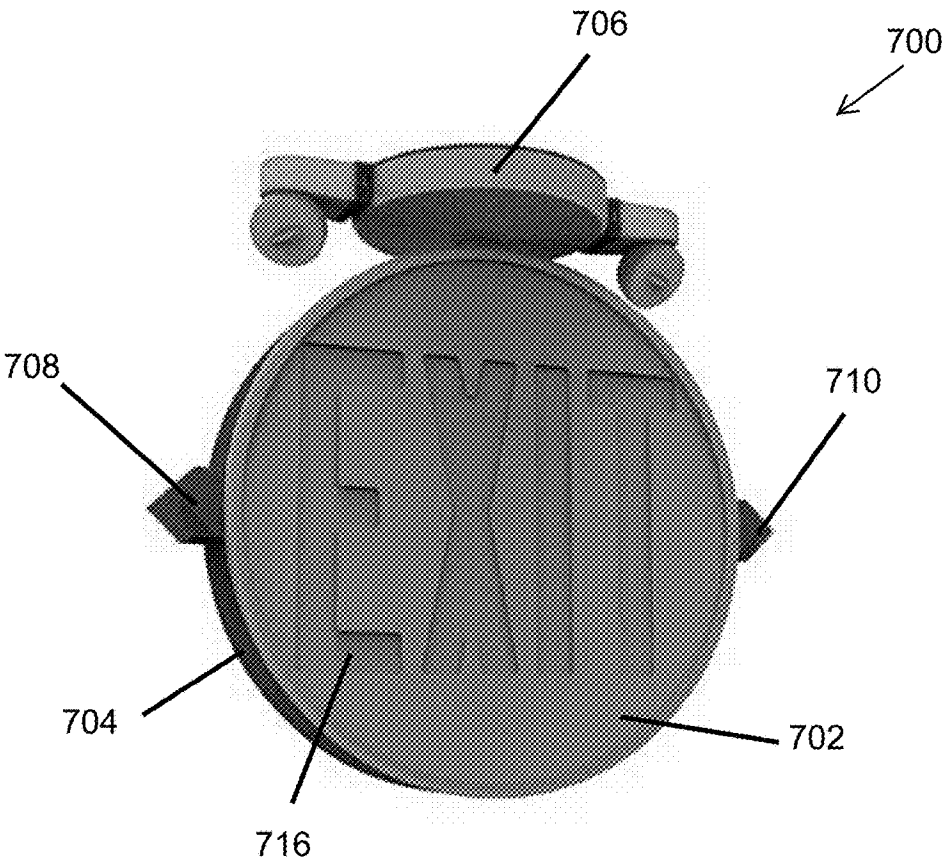
FIG. 7A illustrates a customizable circular exit sign structure according to another example embodiment.
Figure 7B:
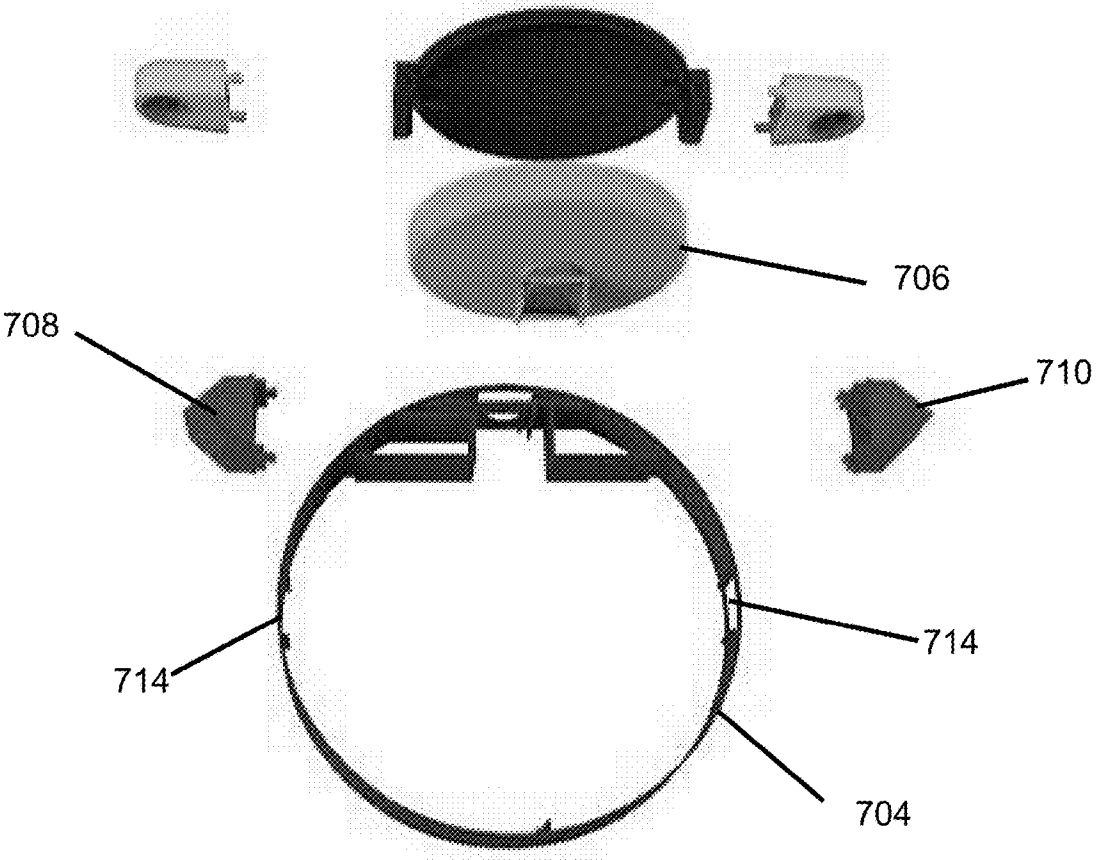
FIG. 7B illustrates an exploded view of the customizable circular exit sign structure of FIG. 7A according to an example embodiment.

FIG. 7A illustrates a customizable circular exit sign structure 700 according to another example embodiment. FIG. 7B illustrates an exploded view of the customizable circular exit sign structure 700 of FIG. 7A according to an example embodiment. Referring to FIGS. 7A and 7B, in some example embodiments, the customizable circular exit sign structure 700 includes a face plate 702 and a frame 704 that is attached to the face plate 702. The face plate 702 may be attached to the frame 704 such that the face plate 702 covers an outer perimeter edge of the frame 704 on one side of the frame 704. The frame 704 may be attached to a mounting structure 706 that may be used to attach the customizable circular exit sign structure 700 to a wall or a ceiling.

In some example embodiments, the customizable circular exit sign structure 700 may also include direction sign structures 708, 710 that may be attached to the frame 704 at respective attachment holes 712, 714 formed in the frame 704. The face plate 702 may include a word EXIT 716 formed in or through the face plate 702. In some example embodiments, the customizable circular exit sign structure 700 may include a second face plate or a back plate across from the face plate 702 similar to the customizable circular exit sign structures 100, 200, 500, 600. The face plate 702 and frame 704 may be attached to each structure or to other structures of the customizable circular exit sign structure 700 mechanically, chemically, and/or magnetically. The face plate 702, the frame 704, and other components of the customizable circular exit sign structure 700 may be made from the same or similar material and using similar methods as described above with respect to the customizable circular exit sign structure 100.

In some alternative embodiments, one or more of the components of the customizable circular exit sign structure 700 may be omitted or replaced by a different component without departing from the scope of this disclosure. For example, one or both of the direction sign structures 708, 710 may be omitted or formed in the face plate 702.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A customizable circular exit sign structure, comprising:

a frame that is ring-shaped, wherein the frame includes an attachment hole formed therethrough to receive in the attachment hole an attachment end of a mounting structure that is used to mount the customizable circular exit sign structure;

a face plate having a word EXIT formed through the face plate, wherein the face plate is attached to the frame on a side of the frame, wherein the face plate includes a surface having a texture;

a letter backing that fully covers the word EXIT formed through the face plate;

a trim ring positioned over a perimeter edge of the frame and a perimeter edge of the face plate, wherein the customizable circular exit sign structure is customizable to include the face plate or a replacement face plate;

a battery positioned in a cavity of the customizable circular exit sign structure to provide a power to one or more electrical components of the customizable circular exit sign structure;

a light emitting diode (LED) light source positioned in the cavity of the customizable circular exit sign structure; and a shelf positioned in the cavity of the customizable circular exit sign structure and designed to hold the LED light source for illuminating the face plate from within the cavity of the customizable circular exit sign structure, wherein the shelf is directly attached to the frame proximal to the attachment hole and extends inwardly from the frame.

2. The customizable circular exit sign structure of claim 1, wherein the face plate is customizable to have a particular texture and a particular trim ring color.

3. The customizable circular exit sign structure of claim 1, further comprising a second face plate attached to the frame on a second side of the frame across from the face plate.

4. The customizable circular exit sign structure of claim 3, wherein the word EXIT is formed through the second face plate.

5. The customizable circular exit sign structure of claim 1, wherein the face plate is replaceable by the replacement face plate, wherein the replacement face plate includes a second surface having a second texture that is different from the texture of the surface of the face plate.

6. The customizable circular exit sign structure of claim 1, wherein the trim ring is replaceable by a replacement trim ring.

7. The customizable circular exit sign structure of claim 1, wherein the face plate is overlaid on a back plate having the word EXIT formed therethrough.

8. The customizable circular exit sign structure of claim 1, further comprising a back cover plate attached to the frame on a second side of the frame across from the face plate.

9. The customizable circular exit sign structure of claim 1, further comprising a mounting plate attached to the frame on a second side of the frame across from the face plate, wherein the mounting plate is designed for mounting the customizable circular exit sign structure.

10. The customizable circular exit sign structure of claim 1, wherein the shelf provides a horizontal platform to hold the LED light source.

11. The customizable circular exit sign structure of claim 1, wherein the mounting structure is used to mount the customizable circular exit sign structure to a ceiling or a wall.

12. A customizable circular exit sign structure, comprising:

a frame that is ring-shaped, wherein the frame includes an attachment hole formed therethrough to receive in the attachment hole an attachment end of a mounting structure that is used to mount the customizable circular exit sign structure;

a first face plate having a word EXIT formed through the first face plate, wherein the first face plate is attached to the frame on a first side of the frame and wherein the first face plate is customizable to have a particular appearance;

a letter backing that fully covers the word EXIT formed through the first face plate; and a second face plate, wherein the second face plate is attached to the frame on a second side of the frame across from the first face plate;

a light emitting diode (LED) light source between the first face plate and the second face plate;

a battery positioned between the first face plate and the second face plate; and a shelf positioned in a cavity of the circular exit sign structure and designed to hold the LED light source for illuminating the first face plate from within the cavity of the customizable circular exit sign structure, wherein the shelf is directly attached to the frame proximal to the attachment hole and extends inwardly from the frame.

13. The customizable circular exit sign structure of claim 12, further comprising a trim ring positioned along a perimeter edge of the frame and along a perimeter edge of the first face plate.

14. The customizable circular exit sign structure of claim 13, further comprising a second trim ring positioned along a second perimeter edge of the frame and along a perimeter edge of the second face plate.

15. The customizable circular exit sign structure of claim 12, wherein a second word EXIT is formed through the second face plate.

16. A method of customizing a circular exit sign structure, the method comprising:

removing a first trim ring from the circular exit sign structure, the first trim ring positioned along a perimeter edge of a frame of the circular exit sign structure, wherein the frame includes an attachment hole formed therethrough to receive in the attachment hole an attachment end of a mounting structure that is used to mount the circular exit sign structure;

removing a first face plate from the circular exit sign structure, the first face plate having a word EXIT formed through the first face plate, wherein the circular exit sign structure comprises:

a letter backing that fully covers the word EXIT formed through the first face plate when the first face plate is attached to the frame;

a battery positioned in a cavity of the circular exit sign structure to provide a power to one or more electrical components of the circular exit sign structure;

a light emitting diode (LED) light source positioned in the cavity of the circular exit sign structure; and a shelf positioned in the cavity of the circular exit sign structure and designed to hold the LED light source for illuminating the face plate from within the cavity of the circular exit sign structure, wherein the shelf is directly attached to the frame proximal to the attachment hole and extends inwardly from the frame; and attaching a replacement face plate to the circular exit sign structure, wherein the first face plate and the replacement face plate have different appearances from each other.

17. The method of claim 16, further comprising attaching a replacement trim ring to the circular exit sign structure.

18. The method of claim 17, wherein attaching the replacement trim ring to the circular exit sign structure includes attaching the replacement trim ring to the frame of the circular exit sign structure.

19. The method of claim 16, wherein attaching the replacement face plate to the circular exit sign structure includes attaching the replacement face plate to the frame of the circular exit sign structure.

* * * * *